United States Patent [19]

Tsukushi et al.

[11] 4,105,879

[45] Aug. 8, 1978

[54] MAGNETIC PUFFER TYPE GAS CIRCUIT BREAKER

[75] Inventors: Masanori Tsukushi, Hitachi; Katsuichi Kashimura, Takahagi; Kunio Hirasawa; Yoshio Yoshioka, both of Hitachi, all of Japan

[73] Assignee: Hitachi, Ltd., Japan

[21] Appl. No.: 775,196

[22] Filed: Mar. 7, 1977

[30] Foreign Application Priority Data

Mar. 12, 1976 [JP] Japan ..... 51-26160

[51] Int. Cl.[2] ..... H01H 33/88

[52] U.S. Cl. ..... 200/148 A; 200/148 D; 335/15; 335/18; 335/131; 335/201

[58] Field of Search ..... 200/148 A, 150 G, 148 D, 200/148 R; 335/15, 16, 18, 131, 201

[56] References Cited

U.S. PATENT DOCUMENTS

| | | | |
|---|---|---|---|
| 3,582,589 | 6/1971 | Frink | 200/148 A |
| 3,621,171 | 11/1971 | Yoshioka | 200/148 A |
| 3,721,786 | 3/1973 | Yoshioka | 200/148 A |
| 3,745,281 | 7/1973 | Yoshioka | 200/148 A |
| 3,813,507 | 5/1974 | Kesselring | 200/148 A |
| 4,041,263 | 8/1977 | Noeske | 200/148 A |
| 4,059,741 | 11/1977 | Yoshioka et al. | 200/148 A |

*Primary Examiner*—Robert S. Macon
*Attorney, Agent, or Firm*—Craig & Antonelli

[57] ABSTRACT

In a magnetic puffer type gas circuit breaker including an electromagnetic coil through which a current to be interrupted flows during the breaking operation, and an electromagnetic repulsive member which produces an electromagnetic repulsive force in cooperation with the electromagnetic coil and drives movable parts of a breaking portion of the apparatus, the electromagnetic repulsive member is so arraged that the electromagnetic neutral position of the electromagnetic repulsive member within the electromagnetic coil at the time when the breaking portion has been closed deviates on the closing side with respect to the electromagnetic center of the electromagnetic coil. Further, the characteristics of the electromagnetic repulsive forces between the electromagnetic coil and the electromagnetic repulsive member are so set that their absolute values become smaller on the closing side than on the breaking side with respect to the point at which the electromagnetic center of the electromagnetic coil and the electromagnetic neutral position of the electromagnetic repulsive member are coincident.

15 Claims, 7 Drawing Figures

MAGNETIC PUFFER TYPE GAS CIRCUIT BREAKER

BACKGROUND OF THE INVENTION

1. Field of the Invention

This invention relates to a magnetic puffer type gas circuit breaker in which an electromagnetic force produced in an electromagnetic driving unit by a current to be interrupted is employed as a breaking energizing force. More specifically, it relates to improvements in the relationship and arrangement between an electromagnetic coil and an electromagnetic repulsive member constituting the electromagnetic driving unit.

2. Description of the Prior Art

The puffer type gas circuit breaker has advantages in that the structure is simple and, since the pressure of $SF_6$ gas used as an insulating medium may be low, the $SF_6$ gas does not liquidize. However, it has the disadvantage that due to provision of a puffer unit for compressing the $SF_6$ gas and blowing it against arcs produced between the contacts, a very large operating force is required for the interruption of a current which exceeds 50 kA, for example. With recent increases in the demand for electric power, there is the tendency to increase the current level at which circuit breakers are to be operated. For this reason, the required operating force for operating the puffer type circuit breaker increases more and more. In order to cope with this problem, the so-called magnetic puffer type gas circuit breaker has been developed in which an electromagnetic force is produced in an electromagnetic driving unit by the current to be interrupted as it flows through the circuit breaker and in which the electromagnetic force is utilized as a supplemental operating force of the circuit breaker.

A prior art magnetic puffer type gas circuit breaker, however, has the disadvantage that when arcs are produced between contacts as a result of an initial discharge during the closing operation of the circuit breaker, a current flows through the electromagnetic coil of the electromagnetic driving unit, an electromagnetic force is produced in the electromagnetic driving unit and this electromagnetic force acts to impede the closing operation.

SUMMARY OF THE INVENTION

An object of this invention is to provide an improved magnetic puffer type gas circuit breaker of the type described which can prevent the electromagnetic driving unit from hindering the closing operation.

Another object of this invention is to provide an improved magnetic puffer type gas circuit breaker which can reduce indesirable influences of an electromagnetic driving unit on the breaking operation.

This invention is characterized by provision of at least one pair of contacts which can be opened and separated from each other; a puffer unit which has a puffer cylinder and a puffer piston and which, when said contacts are opened and separated, compresses an arc-extinguishing gas and blows it against arcs produced between said contacts; an electromagnetic driving unit which is composed of a driver mechanically connected to the movable parts of said contacts and said puffer unit, an electromagnetic coil connected so as to have the current to-be-interrupted flow therethrough, said current creating an electromagnetic field sufficient to provide a driving force to be applied to said movable parts in cooperation with said driver, and an electromagnetic repulsive member which is electromagnetically coupled with said electromagnetic coil to produce an electromagnetic repulsive force; and a commutation unit which commutates the current to-be-interrupted to said electromagnetic coil during breaking; said electromagnetic repulsive member being so arranged that at a closed position of said contacts, an electromagnetic neutral position of said member deviates slightly on a closing side with respect to an electromagnetic center of said electromagnetic coil. Thus, even in the case where a current flows through the electromagnetic driving unit due to an initial discharge when closing the circuit breaker, it becomes possible to reduce the electromagnetic repulsive force in the breaking direction or to make the electromagnetic repulsive force a closing force, and the closing operation can be prevented from being hindered.

Further, this invention is characterized in that the characteristics of the electromagnetic repulsive forces between the electromagnetic coil and the electromagnetic repulsive member are so set that on both sides of a point at which the electromagnetic center of the electromagnetic coil and the electromagnetic neutral position of the electromagnetic repulsive member are coincident, the absolute values of the electromagnetic repulsive forces become smaller on the closing side than on the breaking side. Thus, it becomes possible to diminish the electromagnetic repulsive force acting in the closing direction at the initial stage of the breaking operation and to reduce the undesirable influences thereof on the breaking operation.

Other objects and features of this invention will become apparent from the following description of the preferred embodiments.

DETAILED DESCRIPTION

Figure 1:
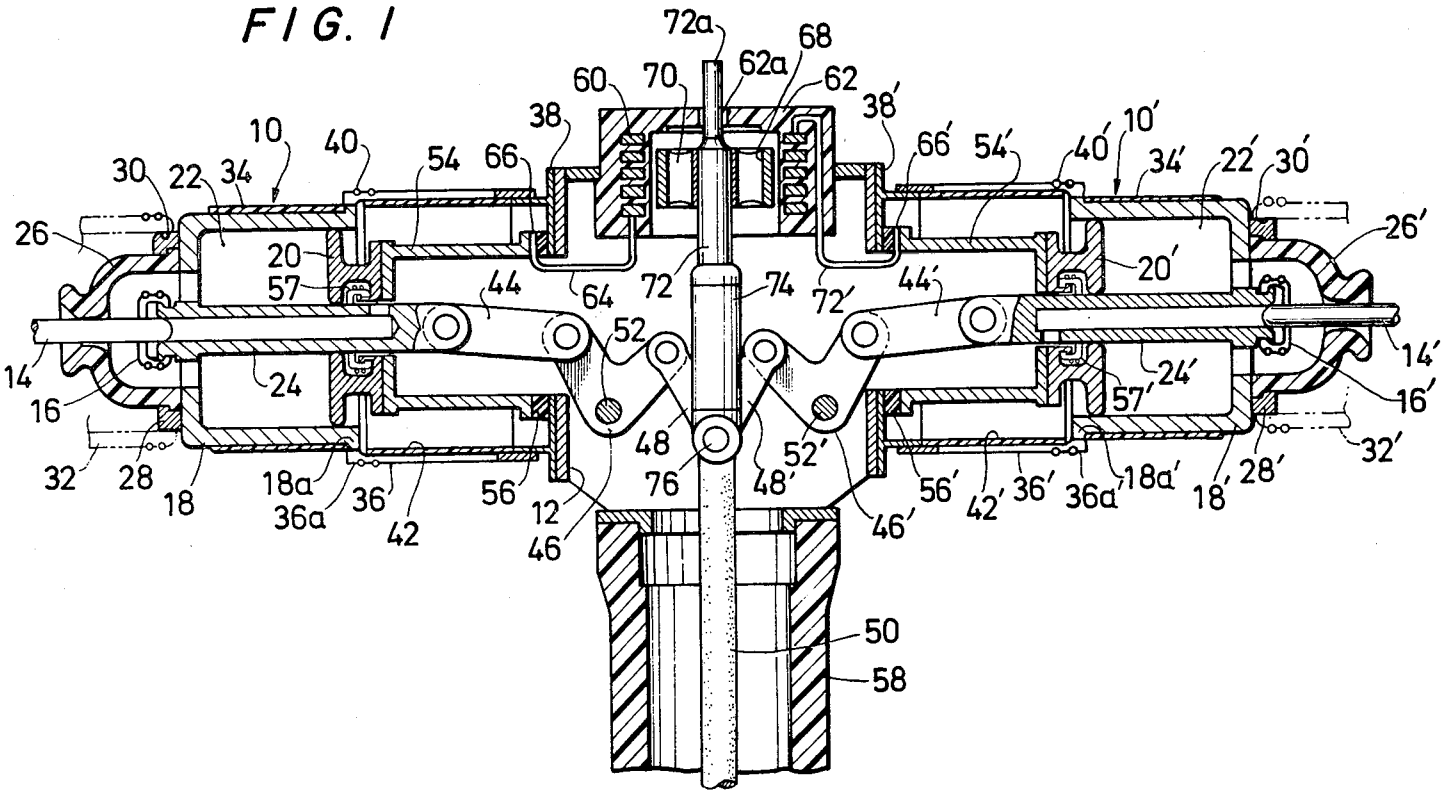
FIG. 1 is a sectional view of a magnetic puffer type gas circuit breaker showing an embodiment of this invention.

Referring now to FIG. 1 showing one embodiment of the present invention, a pair of puffer type breaking units 10 and 10' are symmetrically disposed with a bracket 12 interposed therebetween. These breaking units will now be described mainly by reference to the puffer type breaking unit 10.

A fixed contact 14 and a movable contact 16 are disposed so that the movable contact 16 can be moved into contact with and separated from the fixed contact 14. This movable contact 16 is fixed to a puffer cylinder 18, which moves with the contact 16, and a puffer chamber 22 is formed by this puffer cylinder 18 and a fixed puffer piston 20. When the puffer cylinder 18 is actuated by operation of the puffer cylinder shaft 24 to move to the right, as seen in FIG. 1, an arc-extinguishing gas, such as $SF_6$, is compressed at a high pressure in the chamber 22. This compressed arc-extinguishing gas is blown toward an arc produced between the fixed contact 14 and the movable contact 16 to extinguish the arc.

The arc-extinguishing gas is guided by an electrically insulated nozzle 26 mounted on the puffer cylinder 18 to act effectively on the arc. The electrically insulated nozzle 26 is fixed to the puffer cylinder 18 by an electrically insulated nozzle fitting 28 so as to move therewith. The peripheral face of the nozzle fitting 28 also acts as a movable current contact 30 when the current passing through the breaker increases, and a fixed current contact 32 is disposed in alignment therewith so that the contact 30 can be moved into contact with and separated from the contact 32.

An insulator 34 is formed on the peripheral face of the puffer cylinder 18 with a contact area being provided at 18*a*. The contact area 18*a* of the cylinder 18 is arranged so that the top end 36*a* of a contact 36 comes into contact with cylinder 18 at this point. The contact 36 is fixed to a terminal 38 which is in turn fixed to the bracket 12. A spring 40 is wound on the peripheral portion of the top end 36*a* of the contact 36 to press the top end 36*a* of the contact 36 against the contact area 18*a* of the puffer cylinder 18. An insulator 42 is disposed on the inner face of the contact 36, so that when the puffer cylinder 18 is moved to a pass-opening position, the insulator 42 faces the insulator 34 with a slight clearance left therebetween.

The terminal portion of the puffer cylinder shaft 24 is connected to a link 46 through an electrically insulated rod 44, and the other end of the link 46 is connected to an electrically insulated operating rod 50 through a lever 48. The link 46 is attached to the bracket 12 by a shaft 52 so that it rotates with the shaft 52 being the fulcrum. The puffer piston 20 is supported by a puffer piston stand 54, and the stand 54 is fixed to the bracket 12 through an insulator 56 and is electrically insulated from the bracket 12. A contact 57 in contact with the puffer cylinder shaft 24 is mounted on the base of the puffer piston 20.

The bracket 12 is supported in a state insulated from the ground potential portion of the apparatus by an electrically insulating cylinder 58, and the electrically insulated operating rod 50 penetrates through this insulating cylinder 58 and is actuated by an operating mechanism (not shown) disposed on the ground potential portion. On the side of the bracket 12 opposite the side where the insulating cylinder 58 is disposed, an electromagnetic coil 60 is disposed integrally within a molded insulator 62. The electromagnetic coil 60 is connected with a terminal 66 formed on the puffer piston stand 54 through a conductor 64. An electromagnetic repulsive member 68 is mounted in the hollow portion of the electromagnetic coil 60. This electromagnetic repulsive member 68 is composed of a short-circuit ring or short-circuit coil. The electromagnetic repulsive member 68 is electromagnetically coupled to the coil 60, so that when electric current passes through the electromagnetic coil 60, an electromagnetic repulsive force is produced by the electromagnetic repulsive member 68. The electromagnetic repulsive member 68 is mechanically connected to a central rod 72 by a plurality of ribs 70, and this central rod 72 is mechanically connected to a connecting member 74 which is connected to the electrically insulated operating rod 50 at a connecting point 76. The top end 72*a* of the central rod 72 penetrates through a hole 62*a* formed in the molded insulator 62 and acts as a guide for maintaining a specified clearance between the electromagnetic repulsive member 68 and the electromagnetic coil 60.

The positional relation between the electromagnetic coil 60 and the electromagnetic repulsive member 68 is so determined that, in the closed state of the circuit breaker, the central position of the electromagnetic repulsive member 68 is arranged in a manner to deviate slightly above the position shown in the drawing, i.e., in the closing direction from the electromagnetic neutral position of the electromagnetic coil 60.

The foregoing illustration has been made with reference to the puffer type breaking unit 10, but as is apparent to those skilled in the art, the other puffer type breaking unit 10' disposed symmetrically with the breaking unit 10 with respect to the bracket 12 interposed therebetween has the same structure as described above. Structural members of the breaking unit 10' which are the same as or corresponding to the above illustrated structural members of the breaking unit 10 are indicated by the same reference numerals, with a prime placed after each reference numeral.

Both of the breaking units 10 and 10' are arranged in a grounded tank (not shown) which is connected to ground potential and which is filled with an insulating medium, such as $SF_6$ gas.

The operation of the puffer type gas circuit breaker illustrated in FIG. 1 will now be described.

In the closed state shown in FIG. 1, current passes through a circuit comprising fixed contact 14, movable contact 16, puffer cylinder 18, contact 36, terminal 38, bracket 12, terminal 38', contact 36', puffer cylinder 18', movable contact 16', fixed contact 14'. In this case, the terminal 38 may be short-circuited to the terminal 38' without passing through the bracket 12 by provision of a suitable conductor.

The breaking operation will now be described. The electrically insulated operating rod 50 is pulled down by the external operating mechanism (not shown), whereby the puffer cylinder shaft 24 of the puffer type breaking unit 10 is driven to the right through the lever 48, link 46, and insulating rod 44. Simultaneously, the puffer cylinder shaft 24' of the puffer type breaking unit 10' is driven to the left. By this movement of the puffer cylinder shafts 24 and 24', the cylinders 18 and 18' are also shifted and the arc-extinguishing gas in the puffer chambers 22 and 22' is compressed by the piston 20 as the movable contacts 16 and 16' are opened and separated from the fixed contacts 14 and 14'. The high pressure arc-extinguishing gas produced in the puffer chambers 22 and 22' is guided by the electrically insulated nozzles 26 and 26' and blown toward the arcs produced between the contacts 16 and 14 and between the contacts 16' and 14'. By this breaking operation, the puffer cylinders 18 and 18' are shifted to break contacts between the contact areas 18*a* and 18*a'* of the puffer cylinders 18 and 18' and the contacts 36 and 36'. An arc produced between the contact area 18*a* and the contact 36 will be drawn between the insulators 34 and 42, which are composed of polytetraflurorethylene or a similar material, whereby currents flowing from the puffer cylinders 18 and 18' to the contacts 36 and 36' are broken.

By the above-described breaking operation, the current is caused to flow through a path including movable contact 16, puffer cylinder shaft 24, contact 57, puffer piston 20, puffer piston stand 54, contact 66, conductor 64, electromagnetic coil 60, conductor 64', contact 66', puffer piston stand 54', puffer piston 20', contact 57', puffer cylinder shaft 24', movable contact 16'. Accordingly, the electromagnetic coil 60 is excited and the electromagnetic repulsive member 68 electromagnetically coupled to the electromagnetic coil 60 is urged downwardly by a strong force. This electromagnetic force is transmitted to the levers 48 and 48' through ribs 70, central rod 72 and connecting member 74, whereby the puffer cylinders 18 and 18' are driven by a strong force to drastically increase the pressures inside the puffer chambers 22 and 22'. Accordingly, by a further elevated pressure, the arc-extinguishing gas is blown to each of the arcs produced between the contacts 14 and 16 and the contacts 14' and 16', and hence, the arcs are extinguished to interrupt the large current.

A very large electromagnetic force is imposed between the electromagnetic coil 60 and the electromagnetic repulsive member 68 when the large current is interrupted. Accordingly, the electromagnetic coil 60 is tightly held against the bracket 12 by the molded insulator 62. If desired, this molded insulator 62 may be reinforced by a non-magnetic material or a material of a low electric conductivity.

The operation of converting the apparatus from the opened state to the closed state shown in FIG. 1 will now be described. By driving upwardly the electrically insulated operating rod 50 by means of the external operating mechanism (not shown), the puffer cylinder shaft 24 is moved to the left and the puffer cylinder shaft 24' is moved to the right, whereby the contacts 14 and 14' are moved into contact again with the contacts 16 and 16', respectively, and the closing operation is completed to restore the state shown in FIG. 1.

In this case, in accordance with the present invention, the center of the electromagnetic repulsive member 68 in the axial direction thereof is arranged in a manner to deviate slightly in the closing direction from the center of the electromagnetic coil 60 in the axial direction thereof in the closed state of the circuit breaker. For this reason, even when a current flows through the electromagnetic coil 60 in case where an initial discharge occurs between the fixed contact 14 and the movable contact 16 in or after the middle stage of the closing operation, any large force in the direction of checking the closing force is not produced in the electromagnetic repulsive member, and the closing operation is not hindered. When the position at which the puffer cylinder 18 and the contact 36 are in contact is reached, no current flows through the electromagnetic coil 60.

Figure 2:
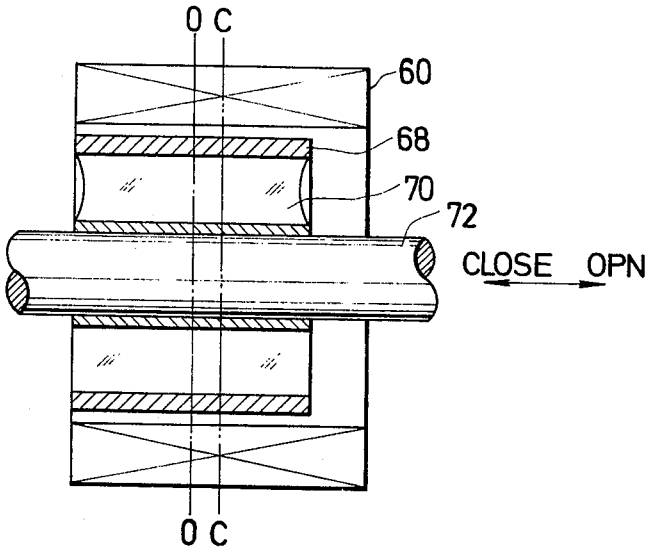
FIG. 2 is a sectional view showing an electromagnetic driving unit in the circuit breaker in FIG. 1.

FIG. 2 shows in detail the positional relation between the electromagnetic coil 60 and the electromagnetic repulsive member 68. In the figure, the central position 0 — 0 of the electromagnetic repulsive member 68 in the axial direction thereof is arranged in the manner to deviate in the closing direction of the circuit breaker with respect to the central position C — C of the electromagnetic coil 60 in the axial direction thereof.

Figure 3:
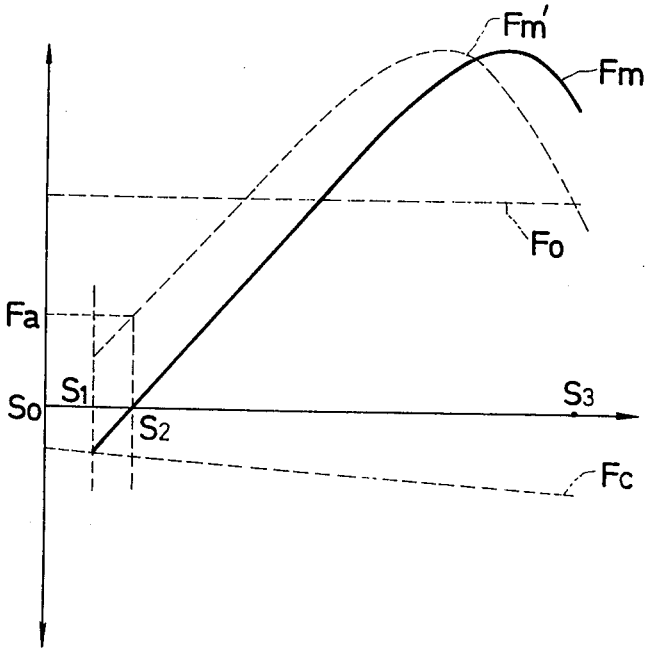
FIG. 3 is a diagram of the operating characteristics of the unit in FIG. 2.

FIG. 3 shows the characteristics of the electromagnetic driving unit constructed as shown in FIG. 2. Referring to FIG. 3, $F_m$ denotes the electromagnetic repulsive force produced between the electromagnetic coil 60 and the electromagnetic repulsive member 68, $F_o$ the driving force in the breaking direction produced by the external operating means, not shown, and $F_c$ the driving force in the closing direction by the external operating means. $F_m'$ denotes the characteristic of a prior art unit in which the centers C — C and 0 — 0 of the electromagnetic coil 60 and the electromagnetic repulsive member 68 in the axial direction thereof are coincident. $S_0$ indicates the closing position of the circuit breaker, $S_1$ the position at which the puffer cylinder 18 and the contact 36 are contacted and separated, $S_2$ the maximum position at which an initial discharge is produced between the contacts 14 and 16, and $S_4$ the breaking completing position. Owing to the selection of the relation between the electromagnetic coil 60 and the electromagnetic repulsive member 68, as shown in FIG. 2, the electromagnetic repulsive force $F_m$ becomes zero at the position $S_2$ at which the initial discharge occurs, at the time of the closure and becomes the force in the closing direction in the interval from the position $S_2$ to the position $S_1$ when the closure has been made. For this reason, even if the initial discharge occurs between the contacts 14 and 16 at the time of the closure, the closing operation is not hindered. In contrast, in the case where the electromagnetic repulsive force characteristic is as illustrated by curve $F_m'$, the electromagnetic repulsive force $F_a$ is produced when the initial discharge occurs. This electromagnetic repulsive force becomes greater than the driving force $F_c$ in the closing direction and hinders the closure, and there is the possibility that the closure will become impossible. With the construction as shown in FIG. 2, such a problem does not occur.

On the other hand, the electromagnetic repulsive force $F_m$ becomes the force in the closing direction from the positions $S_1$ to the position $S_2$ at the time of the breaking, and it has an undesirable influence on the breaking operation. The electromagnetic repulsive force $F_m$ during this interval, however, is very small relative to the driving force $F_o$ in the breaking direction produced by the external operating means. For this reason, the force in the direction opposite to that of the breaking operation does not impede the breaking operation. Beyond the stroke $S_2$, the electromagnetic repulsive force $F_m$ becomes the force in the breaking direction and can establish in cooperation with the driving force $F_o$ a driving force large enough to effect the breaking operation.

Figure 4:
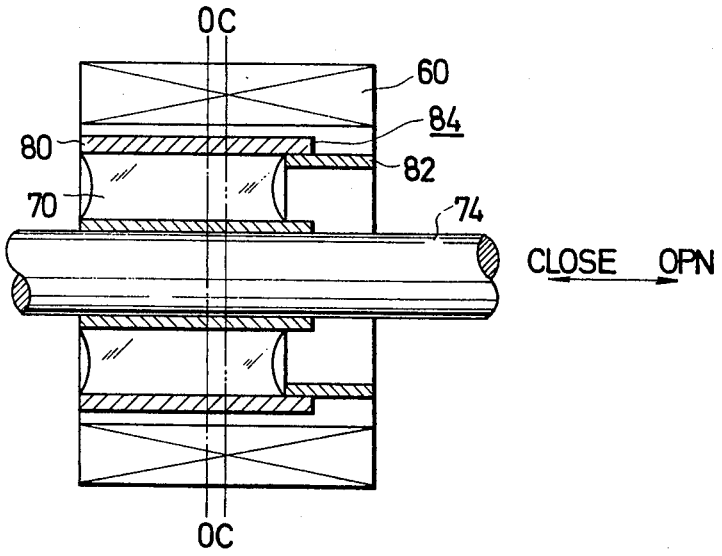
FIG. 4 is a sectional view of an electromagnetic driving unit showing another embodiment of this invention.

FIG. 4 shows another embodiment of this invention, and illustrates only a portion of the electromagnetic driving unit. In this embodiment, an electromagnetic repulsive member 84 is made up of a first electromagnetic repulsive member 80 and a second electromagnetic repulsive member 82 which is provided at the inside part of the first electromagnetic repulsive member 80 and on the breaking side thereof. The other structures are substantially the same as in the foregoing embodiment. Also in the embodiment of FIG. 4, as in the embodiment shown in FIG. 2, the electromagnetic neutral position 0 — 0 of the electromagnetic repulsive member 84 deviates on the closing side with respect to the electromagnetic center C — C of the electromagnetic coil 60.

Figure 5:
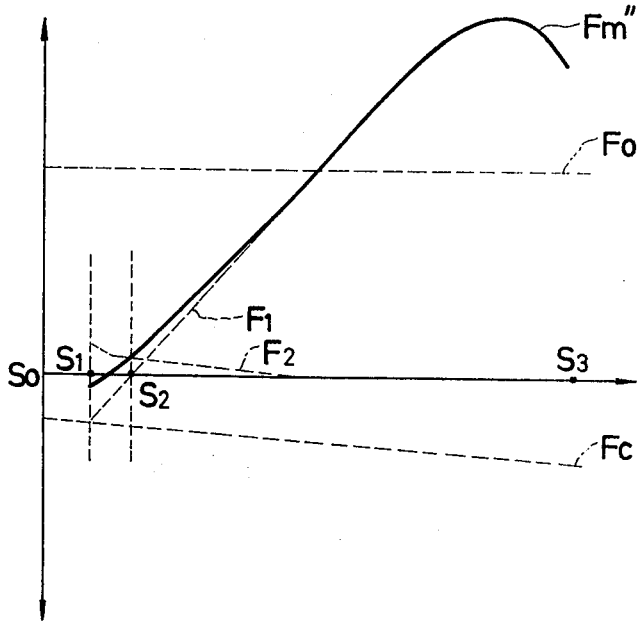
FIG. 5 is a diagram of the operating characteristics of the unit in FIG. 4.

FIG. 5 illustrates the characteristic of the electromagnetic repulsive force $F_m''$ in the electromagnetic driving unit shown in FIG. 4. The combination between the electromagnetic repulsive force $F_1$ of the first electromagnetic repulsive member 80 and the electromagnetic repulsive force $F_2$ of the second electromagnetic repulsive member 82 becomes the electromagnetic force $F_m''$ of the electromagnetic repulsive member 84. As illustrated in FIG. 5, the embodiment of FIG. 4 is so constructed that the electromagnetic repulsive force $F_m''$ becomes zero at the middle of the period between the strokes $S_1$ and $S_2$. Owing to the characteristic in FIG. 5, even when an initial discharge occurs at the stroke $S_2$ at the time of the closure, the electromagnetic repulsive force in the breaking direction does not affect the closing operation significantly because it is very small as compared with the driving force $F_c$ in the closing direction. During the breaking operation, the electromagnetic repulsive force $F_m''$ in the closing direction is smaller than that shown in FIG. 3. It is therefore possible to further reduce the undesirable influence of this force during the breaking operation.

Figure 6:
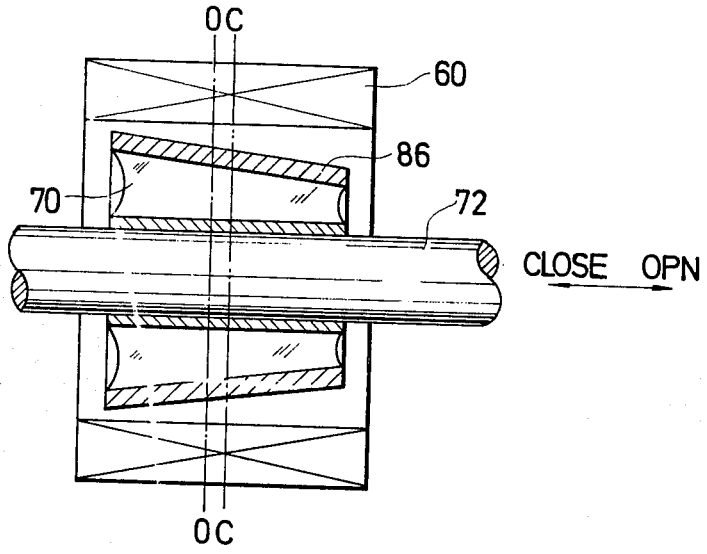
FIGS. 6 and 7 are sectional views of electromagnetic driving units showing further embodiments of this invention.

FIG. 6 shows still another embodiment of this invention. In this embodiment, an electromagnetic repulsive member 86 is so constructed that the spacing between the electromagnetic coil 60 and the electromagnetic repulsive member 86 is smaller on the closing side (left side in the figure) than on the breaking side (right side in the figure). As a consequence, the electromagnetic neutral position 0 — 0 of the electromagnetic repulsive member 86 relative to the electromagnetic coil 60 comes on the closing side beyond the electromagnetic center C—C of the electromagnetic coil 60. In this embodiment, the electromagnetic repulsive force characteristic is substantially the same as illustrated in FIG. 5.

Figure 7:
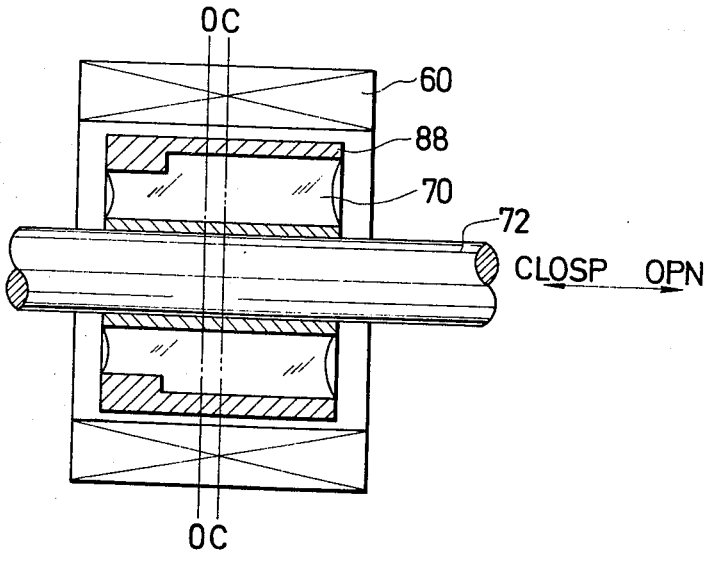

FIG. 7 shows yet another embodiment of this invention. In this embodiment, an electromagnetic repulsive member 88 is so constructed that the thickness of the conductor of the member 88 is increased on the closing side (left end side in the figure). Thus, the electromagnetic neutral position 0 — 0 of the electromagnetic repulsive member 88 comes to lie on the closing side with respect to the electromagnetic center C — C of the electromagnetic coil 60. In this way, even when an initial discharge occurs at the time of the closure, no electromagnetic repulsive force capable of hindering the closing force is produced in the electromagnetic driving unit.

Although, in the foregoing embodiments, the magnetic puffer type gas circuit breaker of the form illustrated in FIG. 1 has been referred to, this invention can be similarly performed in the magnetic puffer type gas circuit breaker of a form in which the breaking portion and the electromagnetic driving unit correspond at 1 : 1.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. In a circuit breaker having at least one pair of contacts mounted for movement into and out of contact with each other and operating means connected to one of said contacts for effecting movement thereof with respect to the other contact to open and close the circuit breaker, electromagnetic driving means for assisting in the opening operation of the circuit breaker comprising a driver connected to said operating means, an electromagnetic coil connected to receive the current to be interrupted, an electromagnetic repulsive member connected to said drive for movement in a closing direction and a breaking direction and being electromagnetically coupled to said coil to produce an electromagnetic repulsive force on said operating means, and commutation means for applying the current to be interrupted to said coil during opening of the circuit breaker to thereby generate said repulsive force which aids said operating means in opening the circuit breaker, said repulsive member being arranged in said coil so that at a closed position of said contacts the electromagnetic neutral point of said repulsive member deviates slightly on the closing side with respect to the electromagnetic center of said coil.

2. The magnetic puffer type gas circuit breaker according to claim 1, wherein said electromagnetic repulsive member has a cylindrical shape and is so arranged that the central position thereof in an axial direction deviates slightly on the closing side with respect to the central position of the electromagnetic coil.

3. The magnetic puffer type gas circuit breaker according to claim 1, wherein said electromagnetic repulsive member consists of a first electromagnetic repulsive part which is arranged on the closing side, and a second electromagnetic repulsive part which is smaller in diameter than said first electromagnetic repulsive part and which is arranged on the breaking side of the electromagnetic center of said coil.

4. The magnetic puffer type gas circuit breaker according to claim 3, wherein the inside diameter of said first electromagnetic repulsive part and the outside diameter of said second electromagnetic repulsive member are equal and the parts contact each other by way of the respective inner and outer surfaces thereof.

5. The magnetic puffer type gas circuit breaker according to claim 1, wherein said electromagnetic repulsive member is shaped such that the spacing between said electromagnetic repulsive member and said electromagnetic coil varies substantially continuously in the axial direction so as to be smaller at an end of said member on the closing side than at an end thereof on a breaking side of the electromagnetic center of said coil.

6. The magnetic puffer type gas circuit breaker according to claim 1, wherein said electromagnetic repulsive member is made of an electric conductor, and an end part of said electric conductor on the closing side of the electromagnetic center of said coil has its thickness increased with respect to the other end thereof.

7. A magnetic puffer type gas circuit breaker comprising at least one pair of contacts mounted for movement into and out of contact with each other; a puffer unit including a puffer cylinder and a puffer piston responsive to opening of said contacts for compressing an arc-extinguishing gas and blowing it against arcs produced between said opening contacts; operating means for effecting opening and closing of said contacts; an electromagnetic driving unit for aiding the opening operation of said operating means and the operation of said puffer unit including an electromagnetic coil connected to receive the current to-be-interrupted, and an electromagnetic repulsive member electromagnetically coupled with said electromagnetic coil and connected to said operating means for movement in a closing direction and a breaking direction to produce an electromagnetic repulsive force aiding the opening operation of said operating means; and commutation unit which commutates the current to-be-interrupted to said electromagnetic coil upon opening of said contacts; said electromagnetic repulsive member being so constructed that a closed portion of said contacts, the electromagnetic neutral position of said member deviates slightly on the closing side with respect to the electromagnetic center of said electromagnetic coil, and that absolute values of the electromagnetic forces of said electromagnetic coil and said electromagnetic repulsive member at points equally distant from a point at which the electromagnetic center of said electromagnetic coil and the electromagnetic neutral position of said electromagnetic repulsive member are coincident become smaller on the closing side than on a breaking side.

8. The magnetic puffer type gas circuit breaker according to claim 7, wherein said electromagnetic repulsive member consists of a first electromagnetic repulsive part which is arranged on the closing side, and a second electromagnetic repulsive part which is smaller in diameter than said first electromagnetic repulsive part and which is arranged on the breaking side of the electromagnetic center of said coil.

9. The magnetic puffer type gas circuit breaker according to claim 8, wherein the inside diameter of said first electromagnetic repulsive part and the outside diameter of said second electromagnetic repulsive member are equal and the parts contact each other by way of the respective inner and outer surfaces thereof.

10. The magnetic puffer type gas circuit breaker according to claim 7, wherein said electromagnetic repulsive member is made of an electric conductor, and an end part of said electric conductor on the closing side of the electromagnetic center of said coil has its thickness increased with respect to the other end thereof.

11. The magnetic puffer type gas circuit breaker according to claim 7, wherein said electromagnetic repulsive member is shaped such that the spacing between said electromagnetic repulsive member and said electromagnetic coil varies substantially continuously in the axial direction so as to be smaller at an end of said member on the closing side than at an end thereof on a breaking side of the electromagnetic center of said coil.

12. The magnetic puffer type gas circuit breaker according to claim 7, wherein said electromagnetic repulsive member has a cylindrical shape and is so arranged that the central position thereof in an axial direction deviates slightly on the closing side with respect to the central position of the electromagnetic coil.

13. A magnetic puffer type gas circuit breaker comprising at least one pair of contacts mounted for movement into and out of contact with each other; a puffer unit including a puffer cylinder and a puffer piston responsive to opening of said contacts for compressing an arc-extinguishing gas and blowing it against arcs produced between said opening contacts; operating means for effecting opening and closing of said contacts; an electromagnetic driving unit for aiding the opening operation of said operating means and the operation of said puffer unit including an electromagnetic coil connected to receive the current to-be-interrupted, and an electromagnetic repulsive member electromagnetically coupled with said electromagnetic coil and connected to said operating means for movement in a closing direction and a breaking direction to produce an electromagnetic repulsive force aiding the opening operation of said operating means; and a commutation unit which commutates the current to-be-interrupted to said electromagnetic coil upon opening of said contacts; said electromagnetic repulsive member being so constructed that at a closed position of said contacts, the electromagnetic neutral position of said member deviates slightly on the closing side with respect to the electromagnetic center of said electromagnetic coil.

14. The magnetic puffer type gas circuit breaker according to claim 13, wherein said electromagnetic repulsive member consists of a first electromagnetic repulsive part which is arranged on the closing side, and a second electromagnetic repulsive part which is smaller than said first electromagnetic repulsive part and which is arranged on the breaking side of the electromagnetic center of said coil.

15. The magnetic puffer type gas circuit breaker according to claim 13, wherein said electromagnetic repulsive member is shaped such that the spacing between said electromagnetic repulsive member and said electromagnetic coil varies substantially continuously in the axial direction so as to be smaller at an end of said member on the closing side than at an end thereof on a breaking side of the electromagnetic center of said coil.

* * * * *